United States Patent [19]

Sternberger et al.

[11] Patent Number: 4,988,365

[45] Date of Patent: Jan. 29, 1991

[54] PROCESS FOR THE DYEING AND PRINTING OF CELLULOSE FIBERS IN THE ABSENCE OF ALKALI OR REDUCING AGENTS: PRE TREATMENT WITH MODIFIED AMINE

[75] Inventors: Klaus Sternberger, Bad Vilbel; Karl-Heinz Keil, Hanau, both of Fed. Rep. of Germany

[73] Assignee: Hoechst Aktiengesellschaft, Frankfurt am Main, Fed. Rep. of Germany

[21] Appl. No.: 407,308

[22] Filed: Sep. 14, 1989

[30] Foreign Application Priority Data

Sep. 16, 1988 [DE] Fed. Rep. of Germany ..... 3831464

[51] Int. Cl.[5] ..... D06P 1/30; D06P 3/60; D06M 15/55

[52] U.S. Cl. ..... 8/543; 8/554; 8/602; 8/650; 8/673; 8/680; 8/918

[58] Field of Search ..... 8/543, 650, 673, 680, 8/564, 602

[56] References Cited

U.S. PATENT DOCUMENTS

| | | | |
|---|---|---|---|
| 3,544,363 | 12/1970 | Rath et al. | 8/602 |
| 4,588,413 | 5/1986 | Keil et al. | 8/543 |
| 4,806,126 | 2/1989 | Sternberger et al. | 8/543 |

*Primary Examiner*—A. Lionel Clingman

[57] ABSTRACT

A process for the alkali-free dyeing and printing of cellulose fibers by means of reactive dyes, direct dyes, acid dyes, water-soluble sulfur dyes or sulfur vat dyes, which comprises pretreating the textile material to be dyed with a wetting agent and a reaction product of an epihalogenohydrin with ammonia or an amine of the formula

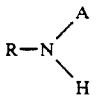

in which

A is hydrogen, alkyl having 1 to 5 carbon atoms, hydroxyalkyl having 1 to 5 carbon atoms, R is alkyl having 1 to 5 carbon atoms, hydroxyalkyl having 1 to 5 carbon atoms, a group of the formula

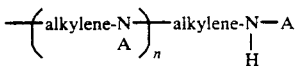

(n=0 to 5), a group of the formula

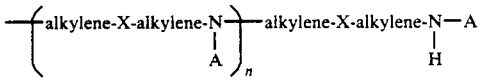

(X=oxygen or sulfur) (n=0 to 5), or R and A together are

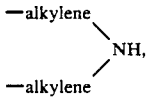

subsequently dyeing them by conventional methods, but without alkali, by means of the dyes mentioned, and completing the dyeing by rinsing, soaping and drying.

6 Claims, No Drawings

PROCESS FOR THE DYEING AND PRINTING OF CELLULOSE FIBERS IN THE ABSENCE OF ALKALI OR REDUCING AGENTS: PRE TREATMENT WITH MODIFIED AMINE

The dyeing of textile materials, such as, for example, woven fabrics, knitted fabrics or even yarns and threads consisting of or containing cellulose fibers, by means of reactive dyes can be carried out by known processes by treating the textile material in the manner of an exhaust process with a dye liquor containing a reactive dye, in most cases at elevated temperature and with most types of commercially available reactive dyes in the presence of alkali, or by using continuous or batch-type processes, such as, for example, the so-called pad-steam process, or the cold pad-batch method. In the pad-steam process as well as in the cold pad-batch method, the textile material is first padded with a reactive dye liquor, the alkali necessary for fixation usually being applied in a separate impregnation step. In the pad-steam process, the fixation of the dye is then completed by a steaming process, in the case of the cold pad-batch method by putting the impregnated material on a batching roll and leaving it at room temperature for several hours. Other possible methods of fixation, such as, for example, treatment of the material padded with an alkali-free reactive dye liquor with sodium hydroxide/-water glass solution have become known and are employed in industry.

In all known reactive dyeing processes, a covalent chemical bond is formed between the dye molecule and cellulose molecule during the dyeing process. For this the presence of alkali is absolutely necessary in all cases.

U.S. Pat. No. 4,806,126 describes a process for the dyeing of cellulose fibers by means of reactive dyes in which the presence of alkali is not required. The fixation of the dyes on the fibers is achieved in this process by pretreating the fibers prior to the dyeing with a reaction product from polyethyleneamine and a bifunctional alkylating agent.

It has now been found that cellulose fibers can be dyed and printed by means of reactive dyes, direct dyes, acid dyes, water-soluble sulfur dyes or sulfur vat dyes without using alkali or a reducing agent by pretreating them with a wetting agent and a reaction product of an epihalogenohydrin with ammonia or an amine of the formula

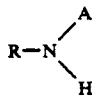

in which

A is hydrogen, alkyl having 1 to 5 carbon atoms, hydroxyalkyl having 1 to 5 carbon atoms, R is alkyl having 1 to 5 carbon atoms, hydroxyalkyl having 1 to 5 carbon atoms, a group of the formula

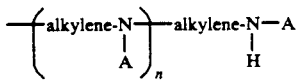

(n=0 to 5), a group of the formula

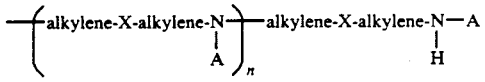

(X=oxygen or sulfur) (n=0 to 5), or R and A together are

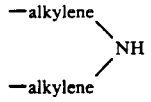

and alkylene is in each case $C_1$–$C_6$-alkylene, preferably $C_2$–$C_3$-alkylene, subsequently dyeing them by conventional methods, but without alkali, by means of the dyes mentioned, and completing the dyeing by rinsing, soaping and drying.

The auxiliary required for the pretreatment is disclosed in U.S. Pat. No. 3,544,363. There the auxiliary is exclusively used for improving the wet fastness properties of dyeings using sulfur dyes. A pretreatment using this auxiliary and subsequent dyeing without alkali is not described there.

The pretreatment agents to be used according to the invention are prepared by reaction of an epihalogenohydrin, preferably epichlorohydrin, with ammonia or an amine of the formula mentioned at temperatures of about 60° to 70° C. in water or a lower alcohol as solvent. These pretreatment agents can, if desired, also be quaternized by means of $C_1$–$C_4$-alkyl groups, preferably $C_1$–$C_3$-alkyl groups. The quaternization can be carried out using alkyl halides, preferably alkyl chlorides, or dialkylsulfonates by known methods.

Examples of suitable amines which conform to the abovementioned formula are: monomethylamine, monoethylamine, monopropylamine, monoisopropylamine, monobutylamine, monoisobutylamine, monohydroxyethylamine, monohydroxypropylamine, ethylenediamine, diaminopropanes, diaminobutanes, diaminohexanes, 3,3'-diaminodipropyl ether, piperazine, monohydroxyethyl-ethylenediamine and dihydroxyethylethylenediamine, diethylenetriamine, dipropylenetriamine, triethylenetetraamine and the like.

The preparation of these pretreatment agent is described in detail in U.S. Pat. No. 3,544,363.

This auxiliary described above is applied to the textile material to be dyed or printed from aqueous liquor together with a wetting agent or padding auxiliary customary in the textile industry. The wetting agents or padding auxiliaries used are alkanesulfonates, dialkyl sulfosuccinates, dialkyl phosphates or propylene oxide/ethylene oxide block polymers containing 40–80 % by weight of ethylene oxide, but in particular nonionic compounds, for example oxethylated nonylphenol. Suitable textile materials include crude or pretreated cotton and also mixed fabrics containing cotton. The process according to the invention is of particular interest for the pretreatment of cotton warp yarns in the sizing liquor by means of the auxiliary described. Subsequent weaving with untreated weft yarns and alkali-free crossdyeing with reactive dyes, followed by washing of the fabric gives a denim effect.

The pretreatment by means of the auxiliary together with a nonionic wetting agent is carried out from aqueous liquor by conventional processes by padding or the exhaust method at temperatures of about 20° to 70° C., preferably 40° to 60° C., and 80° C. to boiling temperature in the sizing liquor. The liquor is adjusted to a weakly acidic pH, preferably pH 6. The amount of auxiliary is about 3 to 10%, preferably 3 to 8%, relative to the weight of the material. The amount of wetting agent is preferably 2 to 4 g/l. The pretreatment liquor is finally squeezed off, and the material is dried.

The material thus pretreated is then dyed by conventional processes and on conventional dyeing machines by means of reactive dyes, for example by the cold pad-batch method, the exhaust method or the thermal fixing method. The liquor ratio in this process can be about 3:1 to 40:1. However, it is important that in this case, in contrast to the previously customary procedure, no alkali is used. The reactive dyes suitable for this process are all known types of reactive dyes which contain groups which are reactive towards the hydroxy groups of cellulose and react under the dyeing conditions described according to the invention, preferably by reaction with the polymers described which have been fixed on the cellulose material. The reactive groups are, for example, groups having easily detachable substituents which leave an electrophilic residue behind, such as reactive groups of the vinylsulfone type, halogen-substituted groups of the ring systems quinoxaline, phthalazine, triazine, pyrimidine or pyridazone or alkylsulfonyl-substituted reactive groups in the case of sulfonylpyrimidine or sulfonylbenzothiazole dyes. Individual examples are dyes containing the reactive groups β-sulfatoethylsulfonyl, β-chloroethylsulfonyl, β-thiosulfatoethylsulfonyl, β-phosphatoethylsulfonyl, chlorotriazinylamino, dichlorotriazinylamino, chlorotriazinyldiamino, trichloropyrimidylamino, dichloropyrimidylamino, dichloropyridazinylamino, trichloropyridazinylamino, dichloropyridazinylcarbonylamino, 2-chlorobenzothiazol-6-ylamino, 2-methylsulfonylbenzothiazol-6-ylamino, 2,3-dichloroquinoxalin-6--ylcarbonylamino or 4-chloro-5-methyl-2-methylsulfonylpyrimid-3-ylamino.

Suitable dye bases of the reactive dyes are, for example, water-soluble azo, disazo, formazan, anthraquinone, dioxazine or phthalocyanine dyes. Water-soluble azo and disazo reactive dyes, which may also be metal complex reactive dyes, are preferably used. After the dyeing, the material is finished by rinsing and, if appropriate, by soaping and drying.

The process according to the invention can be carried out not only by means of reactive dyes, but also in the same manner by means of other types of dyes which contain anionic groups, for example sulfo groups, such as, for example, direct dyes, acid dyes and water-soluble sulfur dyes. These dyes give similar effects and fastness properties as the reactive dyes. Furthermore, sulfur vat dyes can also be used in the process.

The process according to the invention is not only suitable for the dyeing but also for the printing of textile materials. This is done by printing the textile material by means of a printing paste which contains a sighting dye and the auxiliary to be used according to the invention. After drying and fixing, the textile material is then crossdyed by means of reactive dyes without alkali, preferably by the pad-steam method or the exhaust method. Another possibility consists in printing the cotton warps or fabrics which have been pre-mordanted by the auxiliaries described, using a printing paste containing the reactive dye but no alkali, and subsequently fixing the dyeing, for example by steaming at 102°-105° C. for 8 minutes. The subsequent aftertreatment is carried out analogously to that of the dyeings.

The main advantage of the process according to the invention is that as a result of the pretreatment by means of the auxiliary described no alkali or reducing agent is required for the subsequent dyeing. Neither does any alkali enter the waste water during the final washing of the material after the dyeing, so that the pollution of the waste water in the dye houses due to salt is significantly reduced. In addition, as a result of the pretreatment described, an appreciable increase in the color depth of the dyeing compared to a dyeing using the same amount of reactive dye in a conventional dyeing process is also achieved in some cases. The alkali used to a large extent for fixing the reactive dyes includes water glass. If this water glass is not carefully removed by washing after fixation, undesirable deposits of $SiO_2$ can be formed on the material, which can lead to an impairment of the handle. This disadvantage is also avoided in the process according to the invention. This new process also facilitates the removal of unfixed dye residues by washing as a result of not using alkali, since the cotton fiber swells in the presence of alkali and the unfixed dye is absorbed more strongly. This does not take place in the process according to the invention. The solubility of the reactive dyes, which is severely limited by alkali, is much better, and the stability of the neutral dye liquors is higher.

The dyeings produced by the process according to the invention and described above have good wet fastness properties, although, especially in the case of denim effects and individual dyes, slight staining of the uncolored weft thread and especially also a dulled shade occur in some cases.

Surprisingly, it has been found that a washing process carried out immediately after the soaping process by means of perborate-containing detergents increases the brilliance of the dyeings significantly and that the unstained or, depending on the hue of the dye, slightly stained weft thread turns white, thus producing a dye having high brilliance and white weft yarn. The use of optical brighteners in the wash liquor again increases the brilliance of the dyeings and the weft yarns.

These effects are achieved especially if the washing is carried out between 20°-50° C., preferably between 40°-50° C. If the washing by means of the perborate-containing detergent is carried out at higher temperatures, for example 50° to 100° C., preferably 85° to 100° C., the dyeing can be brightened stepwise until the fabric is virtually completely decolored. In this manner, non-uniform dyeings (stone-washed effect) are produced in a manner which is very gentle to the fibers. The only other way to achieve this effect is by means of alkaline hypochlorite solutions and, in some cases, by washing in the presence of pumice.

The amount of alkali metal perborate in the detergents is between about 4 and 25% by weight. Suitable detergents of this type which contain perborate are described in detail in "Tenside" 18, p. 246 (1981).

EXAMPLE 1

On a sizing roll, cotton warp yarns are treated in the box provided for this purpose by means of a liquor of the following composition:

30 g/l polyvinyl alcohol (PVA)
5 g/l polyethylene glycol
4 g/l salt of potassium di-2-ethylhexyl phosphate 60 g/l reaction product from NH: and epichlorohydrin according to DE No. 1,619,391, Example 1.

The liquor pick-up is 100–120%

(high-performance squeezing machine).

The yarn runs at a speed of 15 m/sec and the liquor temperature is 80°–90° C.

After leaving the sizing box, the cotton warps are dried at about 130° C. by contact heat.

Instead of PVA, it is also possible to use starch, modified starch or mixtures of these products. The cotton warps are then weaved with the cotton weft yarn, and the fabric obtained is padded in a cold pad-batch machine consisting of a padder and batching roll by means of a solution having the following composition:

10 g/l C.I. reactive blue 19 (C.I. No. 61200)

4 g/l wetting agent (4-nonylphenol polyglycol ether).

The material thus padded is enveloped air-tight on a batching roll with a polyethylene film and left for a maximum of 24 hours, with rotation.

After the aftertreatment customary for reactive dyes by rinsing, soaping at the boiling temperature and subsequent repeated rinsing, a dyeing having good wear fastness properties is obtained even without the amount of alkali usually necessary for fixing the reactive dyes. Moreover, as a result of the pretreatment of the cotton warps with the reaction product described according to the invention, a considerably greater depth of shade than that obtained in the previously customary fixation using alkalis is produced. The weft of the dyed material turns virtually white during the aftertreatment in the rinsing or after-rinsing process. A fabric having a denim effect is obtained.

EXAMPLE 2

A bleached cotton fabric is padded on a 2- or 3-roll padder with a solution containing 60 g/l of the reaction product according to DE No. 1,619,391, Example 1 and 2 g/l salt of potassium di-2-ethylhexyl phosphate, and is padded after the drying with a liquor containing 10 g/l reactive red 1 (C.I. No. 18158) and 2 g/l wetting agent (4-nonylphenol polyglycol ether).

The dyeing is left according to Example 1 of this application and aftertreated. This gives a deep red dyeing having good wear fastness properties. In contrast, the corresponding cold-pad-batch dyeing which was obtained using the usual amount of alkali (NaOH/water glass) has an only slightly rose-colored hue.

The table below describes further examples which were obtained using different pretreatment agents. In all cases, dyeings are obtained which, compared with the conventional method of fixation using alkali, are distinguished by increased color depth and good fastness properties.

TABLE

| Mol of epichlorohydrin | Amine mol | Dye | Dyeing |
|---|---|---|---|
| 2 mol | 1 mol of $NH_3$ | Reactive red 1 | As Example 1 |
| 3 mol | 1 mol of $NH_3$ | Reactive blue 19 | As Example 1 |
| 2 mol | 1 mol of n-$C_4H_9$—$NH_2$ | Reactive red 1 | As Example 2 |
| 2 mol | 1 mol of $NH_2$—$(CH_2)_3$—$NH_2$ | Reactive blue 19 | As Example 1 |
| 3 mol | 1 mol of $NH_2$—$(CH_2)_4$—$NH_2$ | Reactive blue 19 | As Example 2 |
| 2 mol | 1 mol of $NH_2$—$(CH_2)_6$—$NH_2$ | Reactive red 1 | As Example 1 |
| 2 mol | 1 mol $NH_2$—$CH_2$—$CH_2$—OH | Reactive blue 19 | As Example 2 |
| 2 mol | 1 mol of 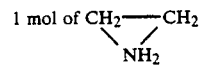 | Reactive blue 19 | As Example 1 |
| 2 mol | 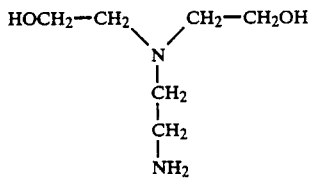 | Reactive red 1 | As Example 2 |
| 2 mol | 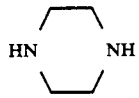 | Reactive blue 19 | As Example 1 |
| 2 mol | $NH_2$—$(CH_2)_3$—NH—$(CH_2)_3$—$NH_2$ | Reactive blue 19 | As Example 1 |
| 1 mol | 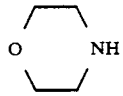 | Reactive red 1 | As Example 2 |
| 2 mol | $NH_2$—$(CH_2)_2$—NH—$(CH_2)_2$—$NH_2$ | Reactive | As Example 1 |

TABLE-continued

| Mol of epichlorohydrin | Amine mol | Dye | Dyeing |
|---|---|---|---|
| | | blue 19 | |

We claim:

1. A process for the dyeing and printing of cellulose fibers by means of reactive dyes, direct dyes, acid dyes, water-soluble sulfur dyes or sulfur vat dyes in the absence of alkali or reducing agents, which comprises pretreating the textile material to be dyed with a wetting agent and a reaction product of an epihalogenohydrin with ammonia or an amine of the formula

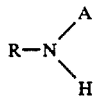

in which

A is hydrogen, alkyl having 1 to 5 carbon atoms, hydroxyalkyl having 1 to 5 carbon atoms, R is alkyl having 1 to 5 carbon atoms, hydroxyalkyl having 1 to 5 carbon atoms, a group of the formula

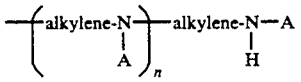

wherein n=0 to 5, a group of the formula

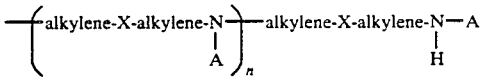

wherein X=oxygen or sulfur, and n=0 to 5, or R and A together are

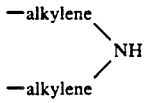

and alkylene is in each case $C_1$–$C_6$-alkylene, subsequently dyeing them by conventional methods, but without alkali, by means of the dyes mentioned, and completing the dyeing by rinsing, soaping and drying.

2. The process as claimed in claim 1, wherein warp yarn is pretreated with the wetting agent and the reaction product together with the sizing liquor in a sizing bath.

3. The process as claimed in claim 1, wherein the reaction product is used in an amount of 3 to 10% of the weight of the material.

4. The process as claimed in claim 1, wherein a customary polymeric padding auxiliary is added to the dye padding liquor.

5. The process as claimed in claim 1, wherein said alkylene is a $C_2$–$C_3$-alkylene.

6. The process as claimed in claim 1, wherein the dyeings or prints are subsequently washed with a washing agent which contains a perborate with or without a perborate activator and optical brighteners.

* * * * *